United States Patent [19]

Taipale

[11] Patent Number: 4,941,514

[45] Date of Patent: Jul. 17, 1990

[54] MULTI-WEFT PAPER MACHINE CLOTH WITH INTERMEDIATE LAYER SELECTED TO CONTROL PERMEABILITY

[75] Inventor: Seppo Taipale, Siilinjärvi, Finland

[73] Assignee: Tamfeld Oy Ab, Tampere, Finland

[21] Appl. No.: 376,898

[22] Filed: Jul. 5, 1989

Related U.S. Application Data

[63] Continuation of Ser. No. 35,460, Apr. 7, 1987, abandoned.

[30] Foreign Application Priority Data

Feb. 10, 1987 [FI] Finland ..... 870537

[51] Int. Cl.[5] ..... D03D 15/00

[52] U.S. Cl. ..... 139/383 A; 162/DIG. 1

[58] Field of Search ..... 139/383 A, 425 A; 162/DIG. 1, 202, 348; 428/225, 255, 258

[56] References Cited

U.S. PATENT DOCUMENTS 4,308,897 1/1982 Westhead ..... 139/383 A
4,351,874 9/1982 Kirby ..... 139/383 A X
4,554,953 11/1985 Borel et al. ..... 139/383 A
4,640,741 2/1987 Tsuneo ..... 139/383 A

FOREIGN PATENT DOCUMENTS

283/68 9/1970 Finland .
68101 3/1985 Finland .
840736 8/1985 Finland .
76145 5/1988 Finland .

OTHER PUBLICATIONS

Advertisement, "Paper" (London) vol. 207, No. 2, Feb. 2, 1987.

*Primary Examiner*—Andrew M. Falik
*Attorney, Agent, or Firm*—Robert M. Isackson

[57] ABSTRACT

A paper machine cloth which comprises longitudinal warp threads and transverse welt threads which are arranged to form a structure of three layers. In order to improve the dewatering properties and the stability of the cloth, the weft threads comprise lower weft threads and surface weft threads which form layers between which intermediate weft threads are woven, the thickness of the intermediate weft threads being chosen according to the desired permeability of the cloth.

14 Claims, 1 Drawing Sheet

MULTI-WEFT PAPER MACHINE CLOTH WITH INTERMEDIATE LAYER SELECTED TO CONTROL PERMEABILITY

This is a continuation, of application Ser. No. 07/035,460 filed Apr. 7, 1987, entitled IMPROVED PAPER MACHINE CLOTH.

The invention relates to a paper machine cloth, comprising longitudinal warp threads and transverse weft threads arranged to form a structure of at least three layers.

Cloths of this type, so called wires, are well-known in the art. Many wire types are manufactured, one-layer wires and multi-layer wires, for instance. Amongst multi-layer wires, two-layers wires are perhaps the best-known, and these have been used for a long time in the paper making.

However, a disadvantage of two-layer wires is that they have poor dewatering properties when the warp threads and the weft threads are woven with a high density. This causes problems in paper machines which are operated at high speeds and in which the dewatering is carried out over a short distance as well as in paper machines in which loading problems arise when high-grammage papers are driven.

The object of the invention is to provide a paper machine cloth by means of which the disadvantages of the prior art can be eliminated. This is achieved by means of a paper machine cloth according to the invention which is characterized in that said weft threads comprising lower threads surface weft threads and intermediate weft threads, said lower weft threads and surface weft threads forming layers between which said intermediate weft threads are woven and interlaced with the warp threads, the thickness of the intermediate weft threads being chosen according to the desired permeability of the cloth.

The paper machine cloth according to the invention is advantageous mainly in that it has good dewatering properties in spite of the high density of the warp and the weft threads. A further advantage is that the transverse stability of the cloth is excellent as compared with prior solutions. This is due to the high weft density. The stability of the paper machine cloth according to the invention in the longitudinal direction is also good by virtue of the high warp coverage. Since the paper machine cloth according to the invention has a high warp and weft density, a great number of supporting points for the supportion of fibers is formed on the cloth surface to be pressed against the paper web, which results in a good retention. Still another advantage is that the wire marking is insignificant, because the cloth surface is formed by densely woven warp and weft threads.

Figure 1:
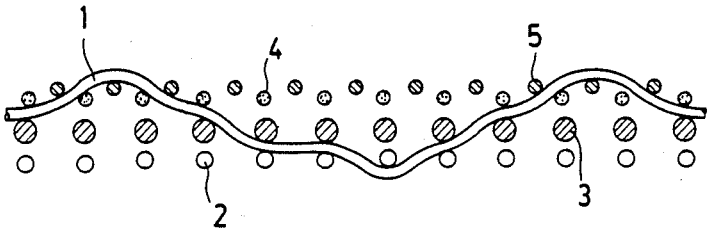
Figure 2:
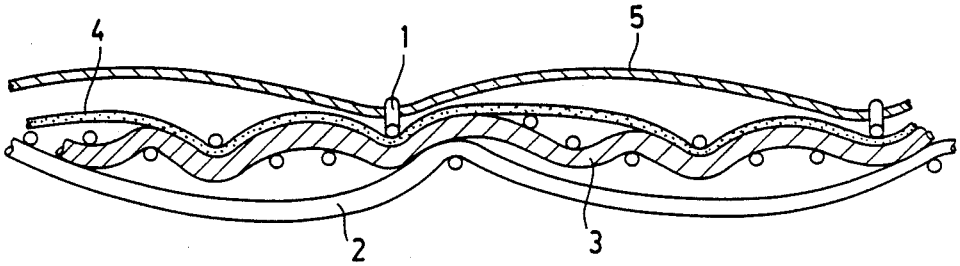

The invention will be described in the following by means of a preferred embodiment thereof shown in the attached drawing, wherein FIG. 1 is a sectional view of a paper machine cloth according to the invention in the warp direction, and FIG. 2 is a sectional view of the cloth of FIG. 1 in the weft direction.

In the example of the figures, warp threads are indicated by the reference numeral 1. The lower side of the wire according to the figures, i.e. the wear side thereof, is formed by thick lower weft threads 2. The function of these threads is to receive all the wearing influence exerted on the weft threads when the wire rotates in a paper machine. The lower weft threads can be made of polyester or polyamide, for instance.

Intermediate weft threads 3 are positioned upon the lower weft threads 2. The surface of the wire is formed by surface weft threads 4, 5. The surface weft threads 4, 5 are substantially equally thick. The water permeability of the wire can be adjusted according to the desired properties by varying the thickness of the intermediate weft threads 3 woven between the layers formed by the lower weft thread 2 and the surface weft threads 4, 5. The intermediate weft threads 3 do not affect the surface structure of the wire, and they are not exposed to wearing, so that these weft threads can be made of any suitable material. The function of the intermediate weft threads 3 is also to increase the transverse stability and the thickness of the wire, which improves the dewatering properties of the wire. An essential feature of the intermediate weft threads 3 is that they have to be as stiff as possible. The intermediate weft threads 3 can be made e.g. of the same material as the lower weft threads. It is thereby preferable to make the intermediate weft threads 3 thicker than the lower weft threads, so that they are stiffer than the lower weft threads 2. The position and passage of the intermediate weft threads 3 between the layers formed by the weft threads 2 and 4, 5 can be chosen completely freely according to the desired wire properties in each particular case.

The structure described above can be advantageously formed in such a manner that one lower weft thread 2, one intermediate weft thread 3 and one surface weft thread 4 are arranged one upon another in the vertical direction so that said weft threads 2, 3, 4 form three layer thread groups. These thread groups appear particularly clearly from FIG. 1. A further surface weft thread 5 is positioned on the surface of the cloth in such a manner that it is always positioned between two adjacent thread groups 2, 3, 4.

The function of the thread groups formed by the lower weft threads 2, the intermediate weft threads 3 and the surface weft threads 4 is to maximize the dewatering properties of the cloth. The function of the further surface weft threads 5 positioned on the surface of the cloth, in turn, is to increase the number of contact points between the cloth surface and the paper.

The above example is by no means intended to restrict the invention, but the invention can be modified within the claims completely freely. Accordingly, it is obvious that the gauze pattern illustrated in the figures is not the only possibility but other kind of solutions are possible as well. The thread thicknesses can be chosen as desired. Examples of possible thread thicknesses are a warp thread thickness of 0.17 mm, a lower weft thread thickness of 0.22 mm, an intermediate weft thread thickness of 0.25 mm and a surface weft thread thickness of 0.17 mm, With these thread thicknesses, an air permeance of substantially 7.200 $m^3/(h \times m^2)$ can be obtained when the warp coverage is over 110 percent and the weft density exceeds the warp density. The thread materials can, of course, be chosen completely freely according to the requirements in each particular case. The lower weft thread and the intermediate weft thread can equal in thickness if this is considered to be advantageous. The permeability measurements have been carried out in accordance with the Finnish SFS 4782 standard. This standard is based on the German DIN 53887 standard.

What is claimed is:

1. A multi-layer paper machine cloth having a single system of longitudinal warp threads and a multiple system of transverse weft threads, and a pre-selected permeability value, said transverse weft threads comprising:

a surface layer including a first plurality of weft threads having a first thickness;

a lower layer including a second plurality of weft threads having a second thickness; and an intermediate layer including a third plurality of weft threads having a third thickness, said intermediate layer being between said surface layer and said lower layer and said warp threads being interlaced with an woven to bind the surface, intermediate and lower weft layers, said third thickness being selected relative to said first and second thicknesses so that the overall permeability of the cloth is at said preselected permeability value.

2. The multi-layer paper machine cloth of claim 1 wherein said third thickness is greater than said second thickness.

3. The multi-layer paper machine cloth of claim 1 wherein said third thickness is further selected relative to said first and second thicknesses so that said intermediate layer weft threads have a greater stiffness than said lower layer weft threads.

4. The multi-layer paper machine cloth of claim 1 wherein said intermediate layer weft threads are made of the same material as said lower layer weft threads.

5. The multi-layer paper machine cloth of claim 4 wherein said first thickness is about 0.17 mm, said second thickness is about 0.25 mm, said third thickness is about 0.22 mm and said permeability is an air permeance of about $7.2m^3/(h \times m^2)$.

6. The multi-layer paper machine cloth of claim 1 wherein said surface layer further comprises a fourth plurality of transverse weft threads, and wherein said transverse weft threads are arranged so that said first plurality of weft threads, said second plurality of weft threads, and said third plurality of weft threads are vertically aligned, and said fourth plurality of weft threads are arranged between adjacent weft threads of the first plurality of weft threads.

7. The multi-layer paper machine cloth of claim 1 wherein the intermediate layer weft threads are stiffer than the lower layer weft threads.

8. A method of making a multi-layer paper machine cloth having a single system of longitudinal warp threads and a multiple system of transverse weft threads and a preselected permeability value comprising:

providing a plurality of longitudinal warp threads;

providing a first plurality of weft threads having a first thickness and a first stiffness;

providing a second plurality of weft threads having a second thickness and a second stiffness;

providing a third plurality of weft threads having a third thickness and a third stiffness;

weaving said first, second and third pluralities of weft threads transversely and said warp threads longitudinally into a multi-layer cloth having a surface layer defined by said first plurality of weft threads, a lower layer defined by said third plurality of weft threads, and an intermediate layer defined by said second plurality of weft threads, said warp threads being interlaced with and woven so that they bind said surface, intermediate and lower weft threads, said intermediate weft threads being woven so that they do not affect the surface of said cloth; and selecting said second thickness relative to said first and third thicknesses so that the overall permeability of said cloth is at said preselected permeability value.

9. The method of claim 8 wherein said cloth has a preselected stiffness value further comprising selecting the composition of said second plurality of weft threads and said second thickness relative to said first and third pluralities of threads and said first and third thicknesses so that the overall stiffness of said cloth is at said preselected stiffness value.

10. The method of claim 8 wherein said surface layer weft threads and said intermediate layer weft threads are made of the same material.

11. The method of claim 10 further comprising providing said intermediate layer weft threads with a greater thickness than said lower layer weft threads.

12. The method of claim 8 further comprising providing said intermediate layer weft threads with a greater stiffness than said lower layer weft threads.

13. The method of claim 8 wherein said second thickness is greater than said third thickness.

14. A paper machine cloth made according to the method of claim 8, 9, 10, 11, 12, 13.

* * * * *